US007825332B1

(12) United States Patent
Lombard

(10) Patent No.: US 7,825,332 B1
(45) Date of Patent: Nov. 2, 2010

(54) BUNDLED WIRE DEVICE

(76) Inventor: Jason M. Lombard, HC 74 Box 13, Pecos, NM (US) 87552

( * ) Notice: Subject to any disclaimer, the term of this patent is extended or adjusted under 35 U.S.C. 154(b) by 195 days.

(21) Appl. No.: 12/324,214

(22) Filed: Nov. 26, 2008

(51) Int. Cl.
*H01B 11/06* (2006.01)

(52) U.S. Cl. ..... 174/36; 174/74 R; 174/78

(58) Field of Classification Search ..... 174/36, 174/102 R, 103, 105 R, 106, 108, 109
See application file for complete search history.

(56) References Cited

U.S. PATENT DOCUMENTS

| | | | | |
|---|---|---|---|---|
| 1,607,432 | A | 11/1926 | Bryce | |
| 2,106,048 | A | 1/1938 | Candy, Jr. | |
| 3,197,554 | A | 7/1965 | Baker | |
| D314,551 | S | 2/1991 | Brisson | |
| 5,834,699 | A | 11/1998 | Buck et al. | |
| 5,864,094 | A | 1/1999 | Griffin | |
| 5,976,070 | A | 11/1999 | Ono et al. | |
| 6,310,286 | B1 | 10/2001 | Troxel et al. | |
| 6,311,637 | B1 | 11/2001 | Moss | |
| 7,307,211 | B1 * | 12/2007 | Caccia | 174/36 |
| 2006/0137897 | A1 | 6/2006 | Grogl et al. | |
| 2006/0146456 | A1 * | 7/2006 | Williams | 361/42 |

* cited by examiner

*Primary Examiner*—William H Mayo, III

(57) ABSTRACT

A bundled wire device having a first stranded wire, a second stranded wire, and a stranded copper ground wire, wherein the wires are simultaneously coated with a mesh sheath. The mesh sheaths allow heat from the first stranded wire, second stranded wire, and the stranded copper wire to dissipate. The bundled wire device has a third stranded wire also surrounded by the mesh sheath.

10 Claims, 1 Drawing Sheet

BUNDLED WIRE DEVICE

FIELD OF THE INVENTION

The present invention is directed to a bundle of electrical wires. More particularly, the present invention is directed to a bundled wire device for use with direct current (DC) or alternating current (AC) systems.

BACKGROUND OF THE INVENTION

The present invention features a bundled wire device. The bundled wire device may be used with solar photovoltaic and/or wind-powered systems. The bundled wire device comprises a first stranded wire, a second stranded wire, and a stranded copper ground wire. In some embodiments, the bundled wire device further comprises a third stranded wire. The first stranded wire, the second stranded wire, the third stranded wire, and the stranded copper ground wire are wrapped in a mesh sheath, which can allow heat from the wires to dissipate.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
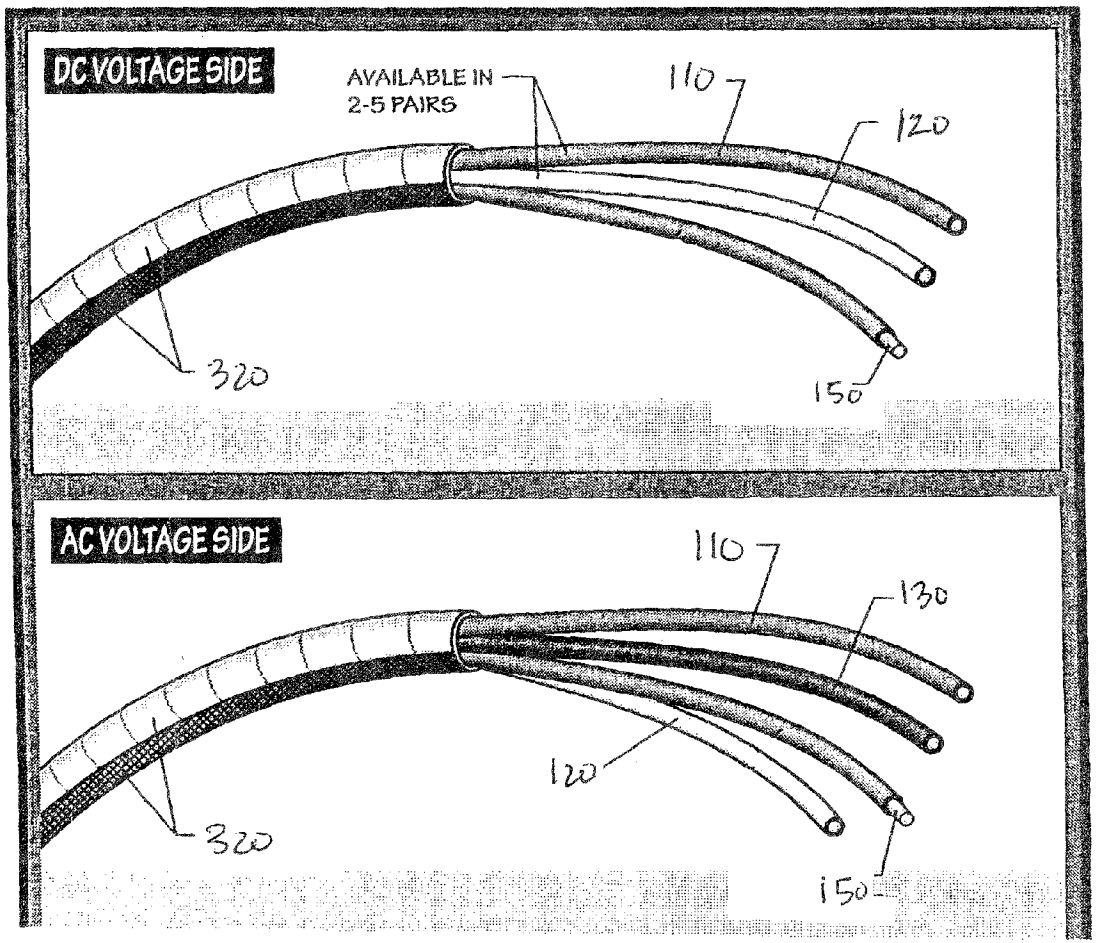
FIG. 1 is a perspective view of the bundled wire device of the present invention.

The following is a listing of numbers corresponding to a particular element refer to herein:

100 bundled wire device
110 first stranded wire (e.g., red wire)
120 second stranded wire (e.g., white wire)
130 third stranded wire (e.g., black wire)
150 stranded copper ground wire
320 mesh sheath Referring now to FIG. 1, the present invention features a bundled wire device. In some embodiments, the bundled wire device may be used with solar photovoltaic and/or wind-powered systems. The bundled wire device can be used in alternating current (AC) and/or direct current (DC) systems.

As used herein, the term "stranded wire" refers to a conductor made of many small thin copper wires bundled together. In some embodiments, the many small thin copper wires are twisted and coated with a polyvinyl chloride (PVC), a pliable plastic material, or the like to form a wire of a particular size (e.g., #10 AWG, etc.).

The bundled wire device comprises a first stranded wire (e.g., red wire, hot wire) and a second stranded wire (e.g., white wire, neutral wire). In some embodiments, the bundled wire device comprises a plurality of first stranded wires and a plurality of second stranded wires. For example, in some embodiments, the bundled wire device comprises two pairs of first stranded wires and second stranded wires. In some embodiments, the bundled wire device comprises three pairs of first stranded wires and second stranded wires. In same embodiments, the bundled wire device comprises four, five, or six pairs of first stranded wires and second stranded wires. In some embodiments, the bundled wire device comprising a first stranded wire and a second stranded wire is used for DC voltages.

Copper ground wires that are currently used in the industry may be stranded or they may be solid. Copper ground wires may be coated in with a polyvinyl chloride (PVC), a pliable plastic material, or the like to form a wire of a particular size (e.g., #10 AWG, etc.). The bundled wire device of the present invention further comprises a stranded copper ground wire.

In some embodiments, the stranded copper ground wire and/or the first stranded wire and/or the second stranded wire is a #4 size, a #6 size, a #8 size wire, a #10 size wire, or the like. The aforementioned sizes refer to American Wire Gauge (AWG) sizes.

The first stranded wire, the second stranded wire, and the stranded copper ground wire are bundled in a mesh sheath. In some embodiments, the mesh sheath allows heat to dissipate from the first stranded wire, the second stranded wire, and the stranded copper ground wire. This can help to prevent overheating of the wires.

In some embodiments, the bundled wire device further comprises a third stranded wire (e.g., black wire, hot wire). In some embodiments, the bundled wire device comprising a third stranded wire is used for AC voltages. In some embodiments, the bundled wire device further comprises a plurality of third stranded wires. In some embodiments, the first stranded wire, the second stranded wire, the stranded copper wire, and the third stranded wire are bundled in a mesh sheath.

Without wishing to limit the present invention to any theory or mechanism, it is believed that the mesh sheath surrounding the stranded wires is advantageous because the mesh sheath helps to keep the wires together. The mesh sheath can also provide increased safety.

The mesh sheath may be constructed from a variety of materials. For example, in some embodiments, the mesh sheath is constructed from a material comprising a polyvinyl chloride (PVC), a rubber, a flexible plastic, a non-polyvinyl chloride material, the like, or a combination thereof. The mesh sheaths are flexible, stretchable, and durable. In some embodiments, the mesh is very smooth, slick, or slippery, which can help a user slide the bundled wire device through a conduit. In some embodiments, the mesh is tear-resistant.

In some embodiments, the mesh has pores. In some embodiments, the pores are between about 0.5 mm to 1.0 mm in diameter. In some embodiments, the pores are between about 1.0 to 2.0 mm in diameter. In some embodiments, the pores are between about 2.0 to 5.0 mm in diameter. As used herein, the term "about" refers to plus or minus 10% of the referenced number. For example, an embodiment wherein the pores are about 2.0 mm in diameter includes pores that are between 1.8 and 2.2 mm in diameter.

Some bundled wires used in the industry are bundled with a solid sheath. In some cases, the solid sheath is removed once the wires are in place. If the surrounding sheath is not removed, it can affect the electricity flow of the wire. For example, heat cannot be dissipated through traditional sheaths, and the heat can degrade the electricity flow of the wire. Without wishing to limit the present invention to any theory or mechanism, it is believed that the mesh sheath of the present invention is advantageous because it dissipates heat, which allows the mesh sheath to remain wrapped around the wires keeping them together and not affect the electricity flow of the wire.

Various formulas can help to determine how much of an effect the standard solid sheathing will have on the electricity flow of a wire. For example, using a #10 AWG with 2 strings of solar PV panels (5 wires including 2 white, 2 red, and 1 green), a ¾" conduit can be used. But, if the standard solid sheathing is on the wires, a 1" conduit may need to be used. The 1" conduit increases the cost and the time needed to complete installation. Using the mesh sheath of the present invention, there would not be a need to increase the conduit from a ¾" conduit to a 1" conduit because heat from the wire will be diffused through the mesh.

Without wishing to limit the present invention to any theory or mechanism, it is believed that the bundled wire device of the present invention is advantageous because the bundled wire device eliminates the need for taping together a plurality of wires from a plurality of spools, which can become tangled. The bundled wire device can also allow a user to easily identify and use proper wire sizes. The bundled wire device can also allow a user to pull a plurality of wires through a metal or a polyvinyl chloride (PVC) conduit.

In some embodiments, the first stranded wire is colored red. In some embodiments, the second stranded wire is colored white. In some embodiments, the stranded copper ground wire is colored green. In some embodiments, the third stranded wire is colored black. In some embodiments, the mesh sheath is colored yellow or green.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A bundled wire device comprising:

(a) a first stranded wire;

(b) a second stranded wire;

(c) a stranded copper ground wire; and (d) a mesh sheath surrounding the first stranded wire, the second stranded wire, and the stranded copper ground wire simultaneously, wherein the mesh sheath allows heat from the first stranded wire, the second stranded wire, and the stranded copper ground wire to dissipate;

wherein the first stranded wire is colored red, wherein the second stranded wire is colored white, and the stranded copper ground wire is colored green.

2. The bundled wire device of claim 1, wherein the bundled wire device further comprises a third stranded wire, wherein the third stranded wire is also surrounded by the mesh sheath.

3. The bundled wire device of claim 2, wherein the third stranded wire is colored black.

4. The bundled wire device of claim 1, wherein the bundled wire device can be used with solar photovoltaic or wind-powered systems.

5. The bundled wire device of claim 1, wherein the bundled wire device can be used in alternating current or direct current systems.

6. The bundled wire device of claim 1, wherein the bundled wire device further comprises a plurality of first stranded wires and a plurality of second stranded wires.

7. The bundled wire device of claim 1, wherein the first stranded wire or the second stranded wire or the stranded copper ground wire is a #4 size, a #6 size, a #8 size wire, a #10 size wire, or the like.

8. The bundled wire device of claim 1, wherein the mesh sheath is constructed from a material comprising a polyvinyl chloride, a rubber, a flexible plastic, the like, or a combination thereof.

9. The bundled wire device of claim 1, wherein the mesh sheath has pores.

10. The bundled wire device of claim 9, wherein the pores are between about 0.5 to 5.0 mm in diameter.

* * * * *